United States Patent [19]

Takahashi et al.

[11] Patent Number: 4,664,095

[45] Date of Patent: May 12, 1987

[54] SAFETY DEVICE FOR OPEN-TYPE COMBUSTOR

[75] Inventors: Mutsuhiko Takahashi, Saitama; Minoru Tadokoro, Tokyo; Hiroshi Matsuzaki, Chiba, all of Japan

[73] Assignee: Hitachi Heating Appliances Co., Ltd., Japan

[21] Appl. No.: 796,812

[22] Filed: Nov. 12, 1985

[30] Foreign Application Priority Data

Nov. 9, 1984 [JP] Japan ..... 59-236387
Nov. 9, 1984 [JP] Japan ..... 59-236388

[51] Int. Cl.[4] ..... F24C 5/04

[52] U.S. Cl. ..... 126/96; 431/15; 431/33; 431/304; 431/201

[58] Field of Search ..... 126/95, 96, 45, 92 R, 126/92 AC; 431/75, 78, 15, 33, 96, 195–201, 304–307; 236/94, 96, 101 D

[56] References Cited

U.S. PATENT DOCUMENTS 1,883,248 10/1932 Wilson et al. ..... 431/15

FOREIGN PATENT DOCUMENTS 202322 11/1984 Japan ..... 431/33
908973 10/1962 United Kingdom ..... 126/96

*Primary Examiner*—James C. Yeung
*Attorney, Agent, or Firm*—Sughrue, Mion, Zinn, Macpeak, and Seas

[57] ABSTRACT

A safety device for an open-type combustor such as a room-type oil stove which is capable of quickly extinguishing the flame of the combustor upon the occurrence of oxygen starvation but which does not operate unnecessarily during ordinary shut-off operations. A thermally deformable element is mounted in the vicinity of a wick guide cylinder or the like for detecting changes in temperature in case of abnormal combustion. An interlock body provided through an operating lever operates an automatic fire-extinguishing unit in response to the thermally deformable element. An engagement/locking portion is provided in the vicinity of the thermally deformable element for engaging and locking the interlock body.

18 Claims, 6 Drawing Figures

SAFETY DEVICE FOR OPEN-TYPE COMBUSTOR

BACKGROUND OF THE INVENTION

The present invention relates to safety devices for open-type combustors, which are employed to extinguish fires in the case of abnormal combustion, for example, room oxygen starvation or the like.

Conventional open-type combustors such as oil stoves or the like when used in a closed room may reduce the oxygen concentration within the room to the point where there is a danger of oxygen starvation. For improving the safety of such open-type combustors, there has been proposed a device for issuing an alarm or extinguishing the fire which includes a control circuit for operating an alarm or a fire-extinguishing device in response to an output from an oxygen starvation sensor mounted on an outer casing provided above a combustion cylinder of the combustor. Such an arrangement is disclosed, for example, in Japanese Unexamined Patent Publication No. 58-99620.

Particularly, as to the fire-extinguishing device, as disclosed in Japanese Unexamined Utility Model Publication No. 50-55239 and Japanese Utility Model Publication No. 56-20707, there has been proposed a fire-extinguishing device employing a thermally deformable element (such as bimetal or the like) which undergoes a displacement upon a thermal difference, the thermally deformable element being mounted in a place (e.g., in the vicinity of an outer-wick-cylinder or the inside of a fire grate) where a change in temperature occurs at times of abnormal combustion conditions, and an aseismatic (antishock, e.g., response to a seismic shock or the like) automatic extinguishing unit operated by an operating frame linked with the aseismatic automatic extinguishing unit and which is actuated by the displacement force of the thermally deformable element in case of abnormal combustion, for example, in case of oxygen starvation.

However, being disposed on the outer casing above the combustion cylinder, such an oxygen starvation sensor cannot completely accurately detect the temperature of the flame in the case of abnormal combustion such as oxygen starvation. There are further problems in that, because the operating frame is disposed in abutment with the thermally deformable element, the responsiveness of the operating frame to temperature changes of the thermally deformable element is poor so that sometimes the aseismatic fire-extinguishing device or the alarm device cannot be properly operated.

On the other hand, in the case of normal fire extinction, when the temperature at the sensor portion provided with the thermally deformable element falls gradually before extinction is complete, passing the temperature corresponding to oxygen starvation, the oxygen starvation unit, constituted by the oxygen starvation sensor, the thermally deformable element, etc., is unavoidably operated, causing the aseismatic automatic fire-extinguishing unit to operate, and thereby extinguishing the fire earlier than would otherwise occur. This results in a problem that malodorous fumes are generated. Similarly, in the alarm unit, there has been a still further problem that, when the oxygen starvation sensor operates when the temperature drops, a switch is turned on to operate the alarm momentarily.

In the case of dry combustion of the wick (namely, burning the wick without oil so as to clean it), the temperature of the sensor portion provided with the thermally deformable element drops gradually, before complete dry combustion in the same manner as in the case of oxygen starvation, thereby operating the oxygen starvation unit, resulting in another problem that complete dry combustion of the wick cannot be performed. In the alarm unit, there is also a difficulty in that the oxygen starvation alarm may light or sound as the temperature drops.

Moreover, in the case of dry combustion of the wick, there has been a yet further problem that if a dry combustion lock knob locking the oxygen starvation sensor unit is not released properly, the oxygen starvation sensor unit cannot operate in the case of oxygen starvation, nor can the aseismatic automatic fire-extinguishing unit.

SUMMARY OF THE INVENTION

An object of the present invention is thus to provided a safety device for an open-type combustor which overcomes the above problems yet can effect necessary measures quickly in case of abnormal combustion.

This and other objects of the invention are attained by a safety device for an open-type combustor comprising: a thermally deformable element provided in the vicinity of selected one of a wick guide cylinder guiding a wick and an outer-wick-cylinder, the thermally deformable element being arranged to detect a change in temperature in case of abnormal combustion to thereby change its position; an interlock body provided through an operating lever for operating an aseismatic automatic fire-extinguishing unit in response to the thermally deformable element, or an interlock body for operating a switch connected to an alarm in response to the thermally deformable element; and an engagement/locking portion provided in the vicinity of the thermally deformable element to effect engagement/locking of the interlock body.

DESCRIPTION OF THE PREFERRED EMBODIMENTS

Figure 1:
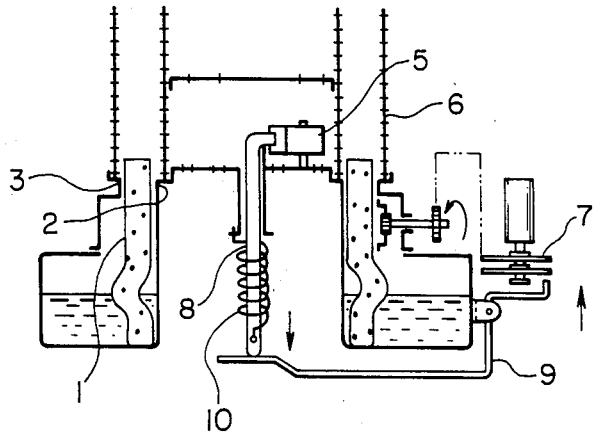
FIG. 1 is a side sectional view of a main part of a first embodiment of a safety device for an open-type combustor according to the invention.

The safety device for an open-type combustor according to the invention is particularly arranged as follows:

an interlock body is provided with a spring or a weight for urging the interlock body downward;

the interlock body has an inverted-L shaped top end and is provided with a spring urging the interlock body into abutment with the engagement/locking portion; and the thermally deformable element has a top end portion provided with a one-way openable gate to admit the interlock body therethrough.

As described above, the safety device according to the invention can be provided with an aseismatic automatic fire-extinguishing unit and an alarm.

As to the aseismatic automatic fire-extinguishing unit, an arrangement is provided as follows:

a normal fire-extinction lock lever for pushing up and locking the interlock body for operating the aseismatic automatic fire-extinguishing unit is provided with an operating knob;

a lock lever engages with a dry combustion lock knob so that it pushes up and locks the interlock body for operating the aseismatic automatic fire-extinguishing unit; and a dry combustion lock knob for pushing up and locking the interlock body for operating the aseismatic automatic fire-extinguishing unit is provided with a normal fire-extinction lock lever responsive to an operation knob for lowering the wick in case of normal fire extinction and releasing the dry combustion lock knob.

The above aseismatic automatic fire-extinguishing unit is usually attached to extinguish fire in response to seismic shock. Such a fire-extinguishing mechanism is also applicable in the case of abnormal combustion.

In operation, the setting of the interlock body is released by the displacement of the thermally deformable element (hereinafter referred to as a bimetal) in case of abnormal combustion such as during times of oxygen starvation so that the interlock body is rapidly lowered and the aseismatic automatic fire-extinguishing unit operated accurately.

That is, the interlock body is disconnected from the engagement/locking portion by the displacement force of the bimetal, and then the aseismatic automatic fire-extinguishing unit is operated by the spring force to thereby extinguish the fire. Since the interlock body is moved by the thermally deformable element when the temperature drops, the interlock body may, to the contrary, strike the thermally deformable element (bimetal) also when the temperature is rising so that the top end of the bimetal bends to ride over the cooperative body. In this case, there is a possibility of deformation of the bimetal, and therefore the bimetal is provided at its top end with a one-way gate which opens freely in the direction of displacement of the bimetal but does not open in the opposite direction. The one-way gate opens even in the case where the bimetal strikes the interlock body when the temperature is rising in the early part of the starting period so that the bimetal can ride over the interlock body smoothly.

In the case where the interlock body is set onto the engagement/locking portion, a compression spring is used to push up the interlock body and rotate the interlock body toward the engagement/locking portion, the spring providing a rotational force toward the engagement/locking portion so that the interlock body is rotated toward the engagement/locking portion only by being pushed; the interlock body can thus be set onto the engagement/locking portion.

For normal fire extinction, an operating knob is used to lower the wick. An oxygen starvation lock lever linked with the operating knob is provided with which the interlock body is pushed up and held so that the oxygen starvation sensor unit and the aseismatic automatic fire-extinguishing unit are locked. For normal fire extinction, even if the operating knob for lowering the wick is moved in the direction of fire extinction, the interlock body cannot move down owing to the lock lever linked with the operating knob. The aseismatic automatic fire-extinguishing unit for use in case of oxygen starvation is locked, as described above, through the lock of the oxygen starvation sensor unit. When the wick is raised by the operating knob for normal combustion, the fire-extinction lock lever rotates to thereby release the locked state of the aseismatic automatic fire-extinguishing unit so that the interlock body becomes free. Accordingly, the aseismatic automatic fire-extinguishing unit for use in case of oxygen starvation can operate freely.

In the case of dry combustion of a wick, the dry combustion lock lever is set so that the interlock body is pushed up by the lock lever linked therewith so that the interlock body cannot move downward, and accordingly the aseismatic automatic fire-extinguishing unit is locked. In short, in the case of dry combustion of a wick, the dry combustion lock lever is set downward along the slit of the dry combustion lock guide so that the interlock body is prevented by the lock lever from moving downward, and accordingly, the aseismatic automatic fire-extinguishing unit is locked. When dry combustion is finished, the setting of the dry combustion lock knob is released so that the interlock body becomes free, and accordingly the aseismatic automatic fire-extinguishing unit is made ready for use in case oxygen starvation occurs.

After dry combustion, the wick is lowered by the operating knob so that the dry combustion lock knob is turned by the normal fire-extinction lock lever linked with the operating knob, and accordingly the dry combustion lock lever is automatically released.

In the case where an alarm unit is provided:

the normal fire-extinction lock lever for pushing up the interlock body for operating the switch to thereby lock the interlock body is provided with the operating knob;

the lock lever engages with the dry combustion lock knob so that it pushes up the cooperative body for operating the switch to thereby lock the interlock structure; and the dry combustion lock knob for pushing up the interlock body for operating the switch to thereby lock the interlock body is provided with the normal fire-extinction lock lever linked with the operating knob for lowering the wick in the case of normal fire-extinction for releasing the dry combustion lock knob.

In this case, the basic arrangement is substantially the same as in the case where the aseismatic automatic fire-extinguishing unit is employed.

In operation:

A thermally deformable element (such as a bimetal or the like) is used to detect the temperature at a place (for example, the upper portion of the wick guide cylinder) where changes in temperature are remarkable in case of abnormal combustion such as oxygen starvation and the interlock body linked with the switch is moved by the displacement force of the thermally deformable element to thereby operate the switch so as to cause the alarm to light or sound in the case of oxygen starvation. That is, the interlock body is separated from the engagement-/locking portion by the displacement force of the bimetal to turn the switch on by the spring force so as to cause the alarm to light or sound.

A first embodiment of the invention, in which an aseismatic fire-extinguishing unit is provided, will now be described with reference to the drawings.

Figure 3:
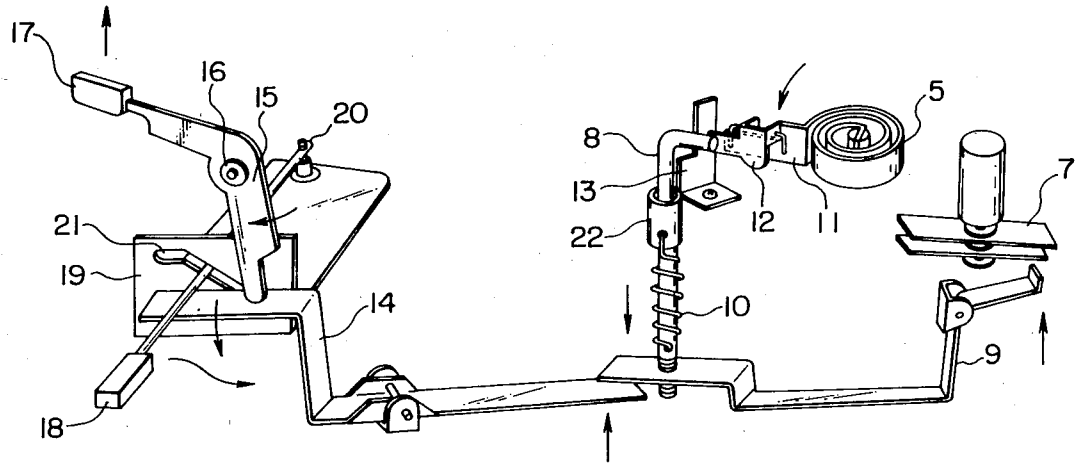
FIG. 3 is a perspective view of a main part of the safety device for the open-type combustor of the first embodiment according to the invention.
Figure 4:
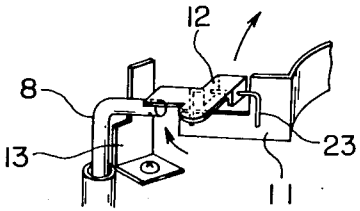
FIG. 4 is an enlarged view of a main part of the first embodiment or a second embodiment according to the invention.

In FIGS. 1, 3 and 4, reference numeral 1 designates a wick which draws up liquid fuel from a tank with the liquid fuel being evaporated from the wick. The wick 1 is supported at its inner and outer sides by a wick guide cylinder 2 and an outer-wick-cylinder 3, respectively. A combustion cylinder 6 is provided on the upper end of each of the wick guide cylinder 2 and the outer-wick-cylinder 3. In the upper end of the wick guide cylinder 2, or in the vicinity of the outer-wick-cylinder 3, there is provided a thermally deformable element 5 placed so as to abut one end of an interlock body 8 linked with an aseismatic automatic fire-extinguishing unit 7 through an operating lever 9. The interlock body 8 is provided with a spring 10, which is downwardly energized to be compressed, with the force of the spring 10 acting on the interlock body 8 to urge it downward (the same effect can be obtained by a weight). The operating lever 9 has one end abutting the lower end of the interlock body 8 or passing therethrough and the other end abutting the aseismatic automatic fire-extinguishing unit 7.

The top end of the interlock body 8, which has an inverted-L shape, abuts an engagement/locking portion 13 when the aseismatic automatic fire-extinguishing unit for use in case of oxygen starvation is activated. The upper end of the compressive spring 10 provided on the interlock body 8 is fixed at its upper end to a guide tube 22 and fixed at its lower end to the interlock body 8. The compressive spring 10 is in a twisted state so the top end of the interlock body 8 is turned toward the engagement/locking portion 13.

A one-way gate 12 is swingably mounted through a pin 23 to the top end of the bimetal 5 abutting the cooperative body 8, such that the door 12 is made to freely open by turning about the pin 23 when the bimetal deforms under a rise in temperature and to shut when the bimetal deforms as the temperature falls.

A lock lever 14 is movably connected at its one end to the interlock body 8 at the lower end thereof through the operating lever 9. One end of a normal fire-extinction lock lever 15 abuts the other end of the lock lever 14. The normal extinction lock lever 15 is arranged to turn at its one end about a shaft 16, and is provided at its other end with an operating knob 17. The shaft 16 is provided with a lever (not shown) for moving the wick 1 up and down.

On the other end of the lock lever 14 which is distant from the lower end of the interlock body 8, there is provided a dry combustion lock knob 18 having a shaft guided as a fulcrum 20 within a slit 21 of a dry combustion lock guide 19. The dry combustion lock knob 18 is pushed back by the operating knob 17 through the normal fire-extinction lock lever 15 linked with the operating knob 17 so that the setting of the dry combustion lock knob 18 is released.

The operation of the above arrangement will be described hereunder.

Figure 2:
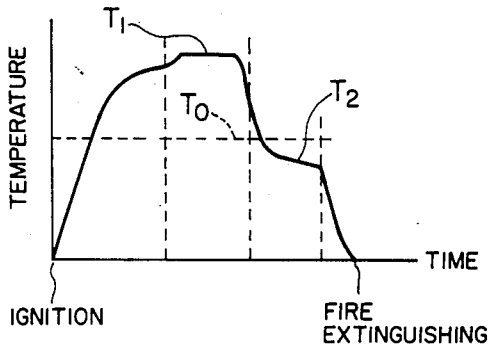
FIG. 2 is a graph of temperature characteristics in case of oxygen starvation at the upper surface of a wick guide cylinder of the safety device for the open-type combustor according to the invention.

Under the condition of normal combustion, the temperature at the upper surface of the wick guide cylinder 2 or the temperature in the vicinity of the out-wick cylinder 3 is held at $T_1$, as shown in FIG. 2, while in the case of oxygen starvation, the temperature in the vicinity of the wick guide cylinder 2 or the out-wick cylinder 3 drops to $T_2$ since the shortage of oxygen in the air retards the combustion reaction in the vicinity of the top end of the wick 1 so that the temperature drops. In the described embodiment, this change in temperature causes displacement of the bimetal 5 provided on the upper surface of the wick guide cylinder 2. In response to the force of displacement of the bimetal 5, the interlock body 8 having the inverted-L shaped top end is turned in the direction of the arrow shown in FIG. 3 in case of oxygen starvation so that the inverted-L shaped body 8 is separated from the engagement/locking portion 13 and then lowered by the force of the spring 10 or under its own weight so as to actuate the aseismatic automatic fire-extinguishing unit 7 through the operation lever 9 provided on the lower end of the interlock body 8 to thereby extinguish the flame. Even if the one-way gate 12 strikes the interlock body 8 during a rise in temperature, the gate 12 can open so as to ride across the interlock body 8 without difficulty.

Next, in the case where the aseismatic automatic fire-extinguishing unit is provided, the interlock body 8 is pushed up by the lock lever 14 so that the inverted-L shaped top end of the interlock body 8 is automatically turned toward the engagement/locking portion 13 by the rotational force of the compressive spring 10 to thereby be set onto the engagement/locking portion 13.

Since the lock lever 14 has one end disposed at the lower portion of the interlock body 8 and the other end provided on the normal fire-extinction lock lever 15, the normal fire-extinction lock lever 15 is turned about the shaft 16 by the operating knob 17 being pushed up in the direction causing fire extinction. For normal fire-extinction, the operating knob 17 is pushed up, and thence the interlock body 8 is pushed up through the lock lever 14 by the normal fire-extinction lock lever 15 so as to lock the oxygen starvation sensor unit to disable the latter, even if the temperature drops.

The lock lever 14, as described above, has one end provided on the lower portion of the interlock body 8 and the other end provided on the dry combustion lock knob 18. Thus, if the lock lever 14 is set in the direction of the arrow along the slit 21 of the dry combustion lock guide 19 by the dry combustion lock knob 18, the interlock body 8 is pushed up by the lock lever 14 so that the fire-extinguishing unit is disabled, even if the temperature drops in the case of dry combustion, and accordingly dry combustion can be attained completely.

Even if the dry combustion lock knob 18 is not released properly upon completion of dry combustion, when the wick 1 is lowered by the operating knob 17, the normal fire-extinction lock lever 15 linked with the knob 17 is turned around the shaft 16 in the direction of the arrow so that the dry combustion lock knob 18 is forcibly turned, and thus the setting thereof is automatically released.

Figure 5:
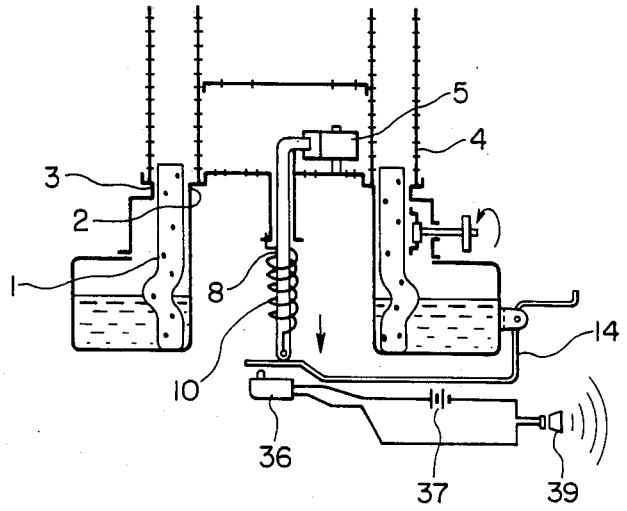
FIG. 5 is a side sectional view of a main part of the safety device for the open-type combustor of the second embodiment according to the invention.
Figure 6:
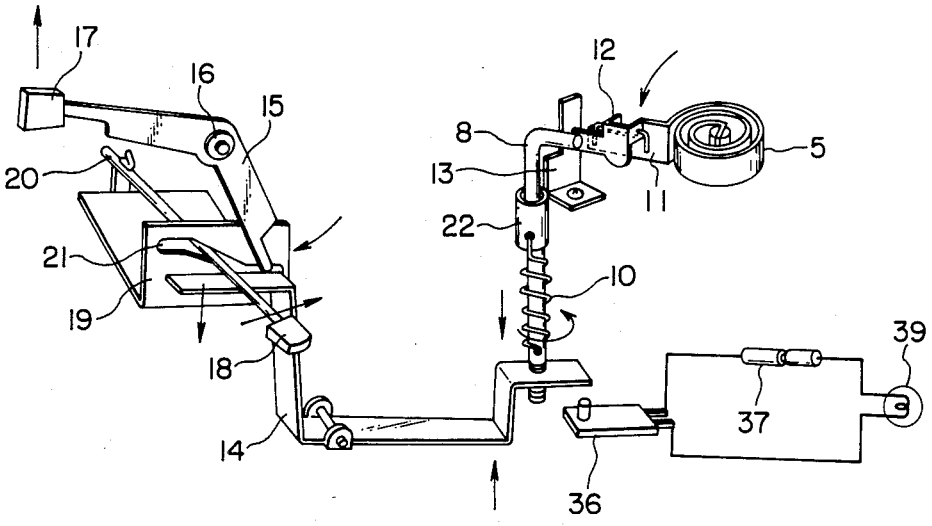
FIG. 6 is a perspective view of a main part of the safety device for the open-type combustor of the second embodiment according to the invention.

FIGS. 4, 5 and 6 show a second embodiment, in which an alarm is provided. Elements the same as in the first embodiment are therein identified by like reference numerals.

A switch 36 is provided on the lower end of the interlock body 8. A power source 37 and an alarm 39 are connected in series with the switch 36.

In the case of oxygen starvation, a shortage of oxygen in the air retards the combustion reaction in the vicinity of the top end of the wick 1 so that the temperature drops. In this case, as described above, the interlock body 8 is lowered by the force of the spring 10 or under its own weight, and then the switch 36 provided on the lower end of the interlock body 8 is operated so as to cause the alarm 39 to light up or sound. Under the condition of normal fire extinction, the interlock body 8 is raised through the lock lever 14 by the dry combustion lock guide 19 so that the oxygen starvation sensor unit and the alarm cannot operate.

As described above, according to the invention, the aseismatic automatic fire-extinguishing unit can operate accurately with good responsiveness due to the force of the spring provided on the interlock body which is separated from the engagement/locking portion by the displacement energy of the bimetal in the case of oxygen starvation at a level assumed to be dangerous. Alternatively, the switch can be actuated by the force of the spring provided on the interlock body so as to make the alarm produce a warning.

In firing up the combustor, the bimetal is not stopped by the interlock body, and accordingly the interlock body can smoothly ride on the one-way gate.

The fire-extinguishing unit for use in case of oxygen starvation can be set onto the engagement/locking portion only by a single operation wherein the interlock body is pushed up by the lock lever so that the inverted-L shaped top end of the interlock body is automatically turned toward the engagement/locking portion by the rotational force of the spring.

For normal fire-extinction, the oxygen starvation sensor unit can be automatically locked only by one operation wherein the operating knob is raised in the direction which causes fire-extinction so that the lock lever pushes up the cooperative body. Therefore, the oxygen starvation sensor unit cannot operate during normal fire-extinction.

For dry combustion of the wick, the oxygen starvation sensor unit can be locked by setting the dry combustion lock knob so as to cause the lock lever to push up the interlock body. Thus, dry combustion can be attained completely.

Another advantage is that the dry combustion lock knob can be automatically released when the wick is lowered by the operating knob 17, even if the dry combustion lock knob is not released properly.

What is claimed is:

1. A safety device for an open-type combustor, comprising:

(a) a wick (1) for supporting combustion;

(b) a wick guide cylinder (2) for supporting and guiding an inner circumference of said wick;

(c) an outer-wick-cylinder (3) for supporting and guiding an outer circumference of said wick;

(d) a thermally deformable element (5) for deforming from a first position to a second position in response to a drop in temperature of the combustion resulting from oxygen starvation in a room containing said open-type combustor, said thermally deformable element being provided proximate to said wick guide cylinder;

(e) an aseismatic automatic fire-extinguishing unit (7) for extinguishing said fire;

(f) an interlock body (8) movable from a first location to a second location in response to deformation of said thermally deformable element from said first position to said second position;

(g) an operating lever (9), engaged with said interlock body, for operating said fire-extinguishing unit to extinguish said fire in reponse to movement of said interlock body from said first location to said second location; and (h) engagement/locking means (13) for engaging a portion of said interlock body when said deformable element is in said first position and releasing said interlock body when said deformable element is in said second position, wherein said interlock body is provided with at least one of a spring (10) and a weight for urging said interlock body in a downward direction toward said second location, whereby said fire-extinguishing unit is prevented from extinguishing said fire until said thermally deformable element is in said second position.

2. The safety device for an open-type combustor according to claim 1, in which an upper end of said interlock body has an inverted-L shape, and said interlock body is provided with a spring for moving said interlock body toward said engagement/locking portion.

3. The safety device for an open-type combustor according to claim 1, in which said thermally deformable element is provided with a one-way openable gate (12) for allowing said deformable element to deform from said second position to said first position with said interlock body in said first location.

4. The safety device for an open-type combustor according to claim 1, further comprising normal fire-extinction lock lever means for locking said interlock body in said first location, whereby said aseismatic automatic fire-extinguishing unit will not be operated when said deformable element deforms from said first position to said second position.

5. The safety device for an open-type combustor according to claim 4, wherein said lock lever means comprises a first normal fire-extinction lock lever (15) movable to a normal fire-extinction locking position, and a second lock lever (14) for engaging with said normal fire-extinction lock lever and locking said interlock body in said first location in response to movement of said first normal fire-extinction lock lever to said normal fire-extinction locking position.

6. The safety device for an open-type combustor according to claim 1, further comprising a dry combustion lock knob (18) movable to a dry combustion locking position, and a lock lever (14) for engaging with said dry combustion lock knob and locking said interlock body in said first location in response to movement of said lock knob to said dry combustion locking position, whereby said aseismatic automatic fire-extinguishing unit will not be operated when said deformable element deforms from said first position to said second position.

7. The safety device for an open-type combustor according to claim 1, further comprising means for moving said interlock body to said first location and locking said interlock body in said first location.

8. The safety device for an open-type combustor according to claim 1, wherein said thermally deformable element is disposed to the inside of said wick guide cylinder.

9. A safety device for an open-type combustor, comprising:

(a) a wick movable to a first height for supporting combustion and to a second height for extinguishing the combustion;

(b) a wick guide cylinder for supporting and guiding an inner circumference of said wick;

(c) an outer-wick-cylinder for supporting and guiding an outer circumference of said wick;

(d) a thermally deformable element for deforming from a first position to a second position in response to a change in temperature of the combustion, said thermally deformable element being provided proximate to one of said wick guide cylinder and said outer-wick-cylinder;

(e) an aseismatic automatic fire-extinguishing unit for extinguishing said fire;

(f) an interlock body movable from a first location to a second location in response to deformation of said thermally deformable element from said first position to said second position;

(g) an operating lever, engaged with said interlock body, for operating said fire-extinguishing unit to extinguish said fire in response to movement of said interlock body from said first location to said second location;

(h) engagement/locking means for engaging a portion of said interlock body when said deformable element is in said first position and releasing said interlock body when said deformable element is in said second position;

(i) dry combustion locking means, including a dry combustion lock knob (18) movable to a dry combustion locking position, for locking said interlock body in said first location; and (j) a normal fire-extinction lock lever (15) for moving said dry combustion lock knob from said dry combustion locking position in response to movement of said wick to said second height for extinguishing the combustion.

10. A safety device for an open-type combustor, comprising:

(a) a wick for supporting a fire;

(b) a wick guide cylinder for supporting and guiding an inner circumference of said wick;

(c) an outer-wick-cylinder for supporting and guiding an outer circumference of said wick;

(d) a thermally deformable element for deforming from a first position to a second position in response to a drop in temperature of a fire in said combustor resulting from oxygen starvation in a room containing said open-type combustor, said thermally deformable element being provided proximate to said wick guide cylinder;

(e) an alarm unit for setting off an alarm;

(f) an interlock body movable from a first location to a second location in response to deformation of said thermally deformable element from said first position to said second position;

(g) an operating lever, engaged with said interlock body, for operating said alarm unit in response to movement of said interlock body from said first location to said second location; and (h) engagement/locking means for engaging a portion of said interlock body when said deformable element is in said first position and releasing said interlock body when said deformable element is in said second position, wherein said interlock body is provided with at least one of a spring and a weight for urging said interlock body in a downward direction toward said second location, whereby said alarm is prevented from being set off until said thermally deformable element is in said second position.

11. The safety device for an open-type combustor according to claim 10, in which an upper end of said interlock body has an inverted-L shape and said interlock body is provided with a spring for moving said interlock body toward said engagement/locking portion.

12. The safety device for an open-type combustor according to claim 10, in which said thermally deformable element is provided with a one-way openable gate (12) for allowing said deformable element to deform from said second position to said first position with said interlock body in said first location.

13. The safety device for an open-type combustor according to claim 10, further comprising normal fire-extinction lock lever means for locking said interlock body in said first location.

14. The safety device for an open-type combustor according to claim 13, wherein said lock lever means comprises a first normal fire-extinction lock lever (15) movable to a normal fire-extinction locking position, and a second lock lever (14) for engaging with said first normal fire-extinction lock lever and locking said interlock body in said first location in response to movement of said normal fire-extinction lock lever to said normal fire-extinction locking position.

15. The safety device for an open-type combustor according to claim 10, further comprising a dry combustion lock knob movable to a dry combustion locking position, and a lock lever for engaging with said dry combustion locking knob and locking said interlock body in said first location in response to movement of said lock knob to said dry combustion locking position.

16. The safety device for an open-type combustor according to claim 10, further comprising means for moving said interlock body to said first location and locking said interlock body in said first location.

17. The safety device for an open-type combustor according to claim 10, wherein said thermally deformable element is disposed to the inside of said wick guide cylinder.

18. A safety device for an open-type combustor, comprising:

(a) a wick movable to a first height for supporting combustion and to a second height for extinguishing the combustion;

(b) a wick guide cylinder for supporting and guiding an inner circumference of said wick;

(c) an outer-wick-cylinder for supporting and guiding an outer circumference of said wick;

(d) a thermally deformable element for deforming from a first position to a second position in response to a change in temperature of the combustion, said thermally deformable element being provided proximate to one of said wick guide cylinder and said outer-wick-cylinder;

(e) an alarm unit for setting off an alarm;

(f) an interlock body movable from a first location to a second location in response to deformation of said thermally deformable element from said first position to said second position;

(g) an operating lever, engaged with said interlock body, for operating said alarm unit in response to movement of said interlock body from said first location to said second location;

(h) engagement/locking means for engaging a portion of said interlock body when said deformable element is in said first position and releasing said interlock body when said deformable element is in said second position;

(i) dry combustion locking means, including a dry combustion lock knob movable to a dry combustion locking position, for locking said interlock body in said first location; and (j) a normal fire-extinction lock lever (15) for moving said dry combustion lock knob from said dry combustion locking position in response to movement to said wick to said second height for extinguishing the combustion.

* * * * *